United States Patent [19]

Bockstruck

[11] 4,454,817

[45] Jun. 19, 1984

[54] BELTED SHOTSHELL

[75] Inventor: Herman N. Bockstruck, Alton, Ill.

[73] Assignee: Olin Corporation, Stamford, Conn.

[21] Appl. No.: 339,238

[22] Filed: Jan. 13, 1982

[51] Int. Cl.[3] ..... F42B 7/00

[52] U.S. Cl. ..... 102/469; 102/448; 42/76 R

[58] Field of Search ..... 42/76 R; 102/448, 464, 102/467, 469; 89/14 R

[56] References Cited

U.S. PATENT DOCUMENTS

| | | | |
|---|---|---|---|
| 53,881 | 4/1866 | Roper | 42/19 |
| 2,831,287 | 4/1958 | Maillard | 42/76 R |
| 3,363,296 | 1/1968 | Duffield | 102/448 |

FOREIGN PATENT DOCUMENTS

| | | | |
|---|---|---|---|
| 2253513 | 5/1973 | Fed. Rep. of Germany | 102/469 |
| 307193 | 2/1937 | Italy | 102/469 |
| 5592 | of 1892 | United Kingdom | 102/469 |
| 27912 | of 1905 | United Kingdom | 102/469 |

OTHER PUBLICATIONS

Winchester/Remington 8 Gauge Industrial Shells (Per Photo), Logan, Cartridges, 1948, pp. 46 and 47, "Caliber 41".

*Primary Examiner*—Charles T. Jordan
*Assistant Examiner*—Ted L. Parr
*Attorney, Agent, or Firm*—Bruce E. Burdick

[57] ABSTRACT

A shotshell having a dual rim or "belted" head design. The belt rim is of greater diameter than the maximum inside diameter of the chamber bore of a standard commercial shotgun of the same gauge size, thus preventing the belted shotshell from being fully chambered in a standard commercial shotgun.

10 Claims, 5 Drawing Figures

BELTED SHOTSHELL

This invention relates to a shotgun cartridge or shotshell.

There has arisen an increased need for a shotgun cartridge which is adapted for combat situations involving the need for rapid fire and multiple projectiles. The presently available rifle and shotguns are not entirely suitable for this application due to limited range in the case of shotguns and insufficient number of projectiles in the case of rifles. As a result of this need, there have been attempts to design and develop shotshells and shotguns having greatly increased firing pressures in order to achieve increased range. For safety purposes it is highly desirable that such high-powered shotshells be incapable of use with conventionally chambered sporting shotguns since such shotguns may not have sufficient strength to contain the pressures developed by such combat shotshells during firing. However, there is also a need for economic reasons to provide for use of commercial shotgun cartridges in a combat shotgun during routine practices and emergency situations. For example, it would be desirable to use standard commercial shotshells for target practice and training purposes and to switch to the higher power combat shotshells in combat situations. Also, it is desirable that combat personnel have the ability to use commercial shotshells in a combat shotgun in combat situations where supplies of combat shotshells run low due to interruption to supply lines or other reasons.

The present invention solves the problem by providing a shotshell which has a head portion attached to one end of a tubular shotshell body where the head portion has a first base rim, an annular extraction recess and a second belt rim equal in diameter to the first base rim, and disposed immediately toward the shotshell mouth from said recess.

Figure 1A:
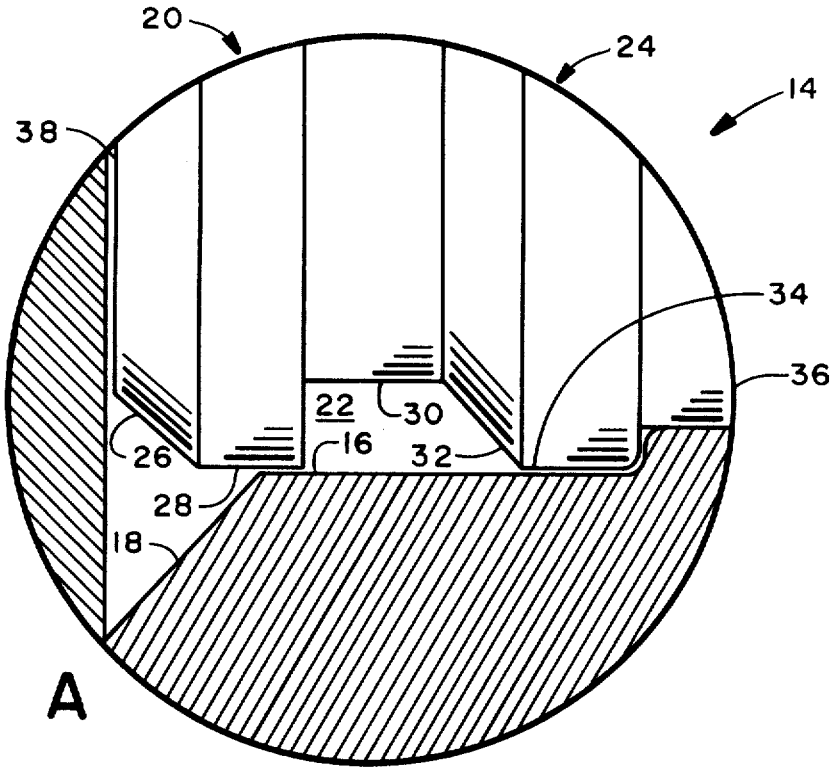
Figure 2A:
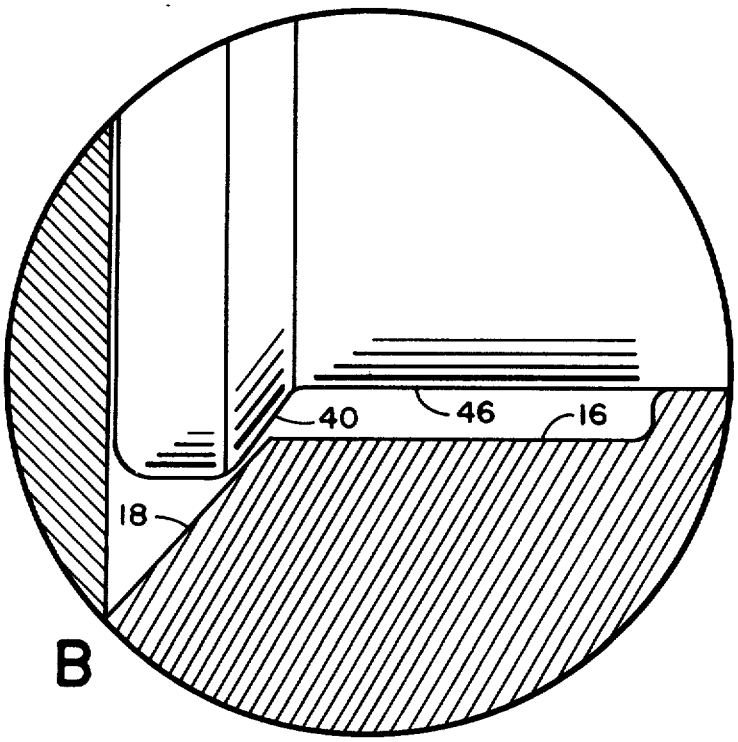
Figure 1:
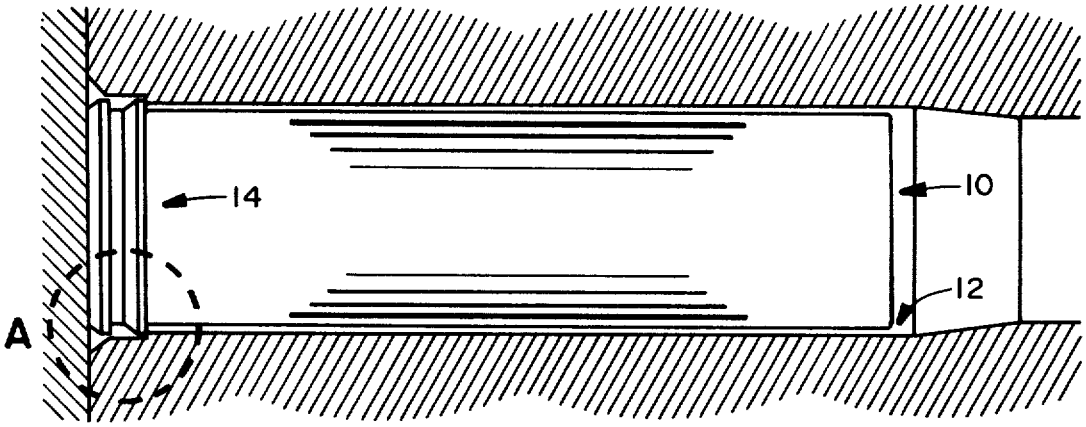
Figure 2:
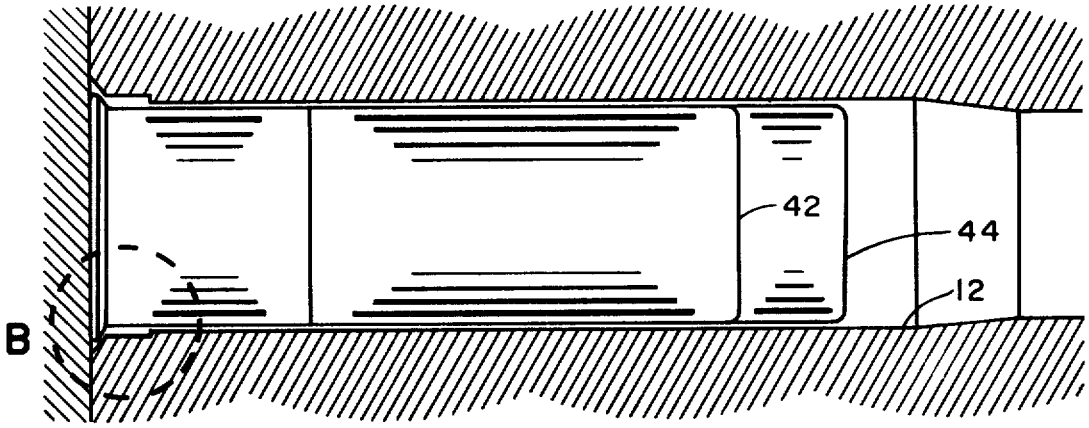
Figure 3:
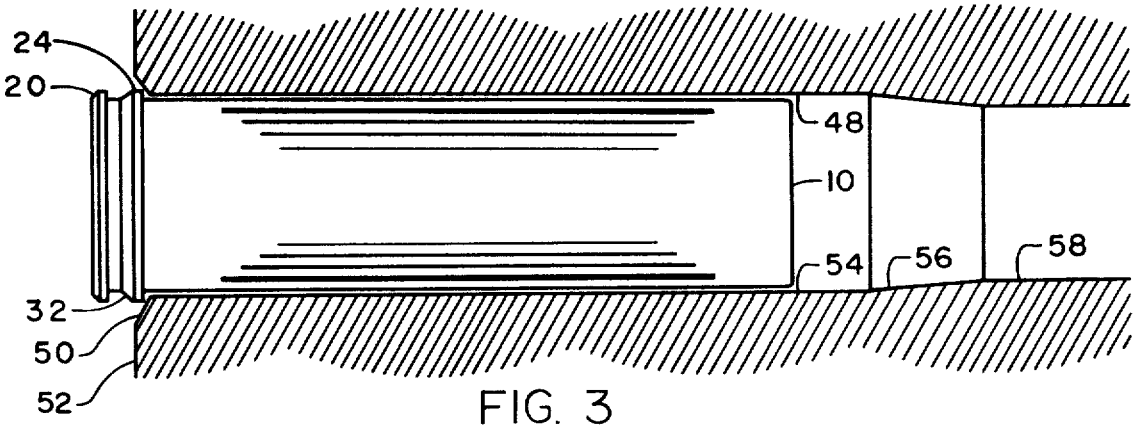

The invention will be better understood by reference to the attached drawings in which:

FIG. 1 is a cross-sectional view along the barrel axis of a combat shotgun of a chambered combat shotgun shell which encloses the invention;

FIG. 1-A which is a close up of portion A of FIG. 1 to show the double head rim and head recess;

FIG. 2 is cross-sectional view along the barrel axis of a combat shotgun showing a chambered commercial shotshell cartridge;

FIG. 2-A which is a close up of portion B of FIG. 2 showing the location of the base rim of a commercial shotshell in the combat shotgun; and FIG. 3 which is a cross-sectional view along the barrel axis of a commercial shotgun with a combat shotshell partially chambered showing the inability to fully chamber the combat shotshell due to the double head rim.

Referring to FIG. 1, combat shotshell 10 is shown in the chamber 12 of a combat shotgun especially adapted to receive shotshell 10. It will be seen that shotshell 10 includes head portion 14 which is adapted to fit within a counterbored recess in chamber 12.

Referring to FIG. 1-A it is seen that shotshell 10 has head portion 14 disposed within a counterboard recess 16 of chamber 12. Recess 16 is of greater inside diameter than the inside diameter of the remainder of the chamber of the shotgun but is of less diameter than a beveled portion 18 adjacent to the barrel breech of the shotgun. Head portion 14 includes a base rim 20, an extraction recess 22 and a second belt rim 24 which lies immediately to the right of recess 22, that is, toward the mouth of the shotshell. Rim 20 has a beveled section 26 facing away from the mouth end of the shotshell and a right cylindrical section 28 immediately toward the mouth end from the beveled section 26. Recess 22 has a right cylindrical wall 30 coaxial with the axis of the shotshell but of a smaller external diameter than the diameter of the remainder of the shotshell. This results in a flat annular radial surface on the side of the base rim towards the mouth of the shotshell to allow for use of greater extraction forces than in prior shotshells. Second belt rim 24 includes a beveled section 32 facing away from the mouth end of the shotshell and has right cylindrical section 34 immediately toward the mouth end from the beveled section 32. Shotshell has a tube portion 36 which is slightly tapered from second rim 24 to the mouth end of the shotshell and which extends from rim 24 to the mouth end. The base end 38 of shotshell 10 is of an outside diameter less than the outside diameter of tube portion 36 at the mouth end of the shotshell 10. Head portion 14 and tube portion 36 are preferably a single integral piece and preferably both consist essentially of cartridge brass to allow for use of loads having higher firing pressures which might damage plastic or paper shells typical of most commercial shotshells. The combat shotshell 10 is preferably a 12 gauge shotshell of at least a 3 inch uncrimped length to make the combat shotgun compatible with commercial 12 gauge shotshells while still receiving the combat shotshell 10.

FIG. 2 shows the appearance of chamber 12 when either a 2¾ inch or 3 inch 12 gauge commercial shotshell cartridge 42 or 44 is chambered in chamber 12. It will be seen that shotshell 44 chambers easily within chamber 12 since the bevel section 18 of chamber 12 adjacent the breech end of the barrel of the combat gun receives the base rim 40 of the 3 inch commercial shotshell. However, it will be noted that the side wall 46 of the head portion of shotshell 42 or 44 does not lie tightly against the chamber wall in chamber recess 16 since chamber recess 16 is of greater internal diameter than the remainder of the chamber 12 in order to allow rims 20 and 24 to be received within chamber recess 16. Although this spacing between the inside wall of chamber recess 16 and the side wall 46 of a commercial shotshell has been previously considered to be undesirable, actual testing of commercial shotshells in a chamber having a chamber recess 16 has demonstrated that this spacing is safe and that side wall 46 remains intact even though it is allowed to expand more than usual.

FIG. 3 shows shotshell 10 partially chambered in the chamber 48 of a conventional 12 gauge sporting shotgun. Chamber 48 conventionally has a beveled section 50 adjacent the breech end 52 of the barrel of the commercial shotgun and has a tapered cylindrical portion 54 extending approximately the length of the shotshell expected to be chambered in chamber 48, typically 2¾ inch or 3 inch. Immediately forward of tapered cylindrical wall 54 is a more sharply tapered cylindrical wall 56 which tapers from wall 54 to the barrel bore 58 of the shotgun. It will be seen that when shotshell 10 is attempted to be chambered in chamber 48 second belt rim 24 cannot pass inside of tapered wall 54. Instead, rim 24 is restrained by beveled section 50 and prevented from passing there through. This results in base rim 20 being held in a position spaced rearward of the breech end of the barrel by some predetermined distance which is sufficient to prevent the conventional breech bolt from assuming a firing position behind rim 20, thus disabling the commercial shotgun and preventing firing of the combat shotshell in such a commercial shotgun.

The rim 20 is beveled at the rear and has a flat front, in contrast to a conventional rim which is generally flat at the rear and beveled on its forward end. The flat front of rim 20 allows a stronger extraction force to be applied to rim 20 than with a conventional beveled rim.

Shotshell 10 can be manufactured by conventional metalworking operations which might, for example, include a series of drawing, ironing, annealing, redrawing (if desired) and further annealing steps. The recessed wall portion can be cut into head portion 14 by a head turning operation so as to produce the flat extraction surface on the side of rim 20 toward the mouth of the shotshell.

From the above disclosure it will be seen that a shotshell is provided which cannot be readily chambered in a commercial shotgun but which fits a chamber which will receive a conventional shotshell. It will be appreciated that minor modifications to the combat shotshell or shotgun chamber can be made without departing from the scope of the invention so long as the combat shotshell is unable to be readily chambered in a conventional shotgun and yet does not require a chamber configuration unable to accommodate conventional shotshells.

I claim:

1. A shotshell comprising:

a tubular body portion having a mouth end and a base end and adapted to contain a shot column within a chamber of a shotgun;

a head portion attached to said base end which includes a base rim at the base of said shotshell, an annular extraction recess immediately adjacent and toward the mouth of said shotshell from said base rim a belt rim of a maximum outside diameter less than the minimum outside diameter of a standard commercial shotshell base rim of the same gauge size as said shotshell and greater than the inside diameter of said recess and greater than the maximum internal diameter of a standard commercial shotgun chamber bore and disposed immediately toward said mouth end from said recess and extending to a greater distance from said base toward said mouth than the axial length of a conventional chamber breeching bevel of a commercial shotgun chamber of the same gauge size.

2. The shotshell of claim 1 wherein said base rim comprises:

a beveled section facing away from said mouth end;

a right cylindrical section immediately toward said mouth end from said beveled section.

3. The shotshell of claim 2 wherein said belt rim comprises:

a beveled section facing away from said mouth end;

a right cylindrical section immediately toward said mouth end from said beveled section.

4. The shotshell of claim 3 wherein the outside diameter of said recess is less than the outside diameter of said tube portion.

5. The shotshell of claim 4 wherein said tube portion is tapered from said base end to said mouth end.

6. The shotshell of claim 5 wherein the end of said head portion away from said mouth end has an outside diameter less than the outside diameter of said mouth end.

7. The shotshell of claim 6 wherein said shotshell consists essentially of cartridge brass.

8. The shotshell of claim 7 wherein said shotshell is a 12 gauge shotshell.

9. The shotshell of claim 8 wherein said shotshell is of a standard 3 inch uncrimped length.

10. The shotshell of claim 1 wherein the outside diameter of said base rim is less than 0.88 inch (the minimum standard 12 gauge base rim diameter) and said shotshell is a 12 gauge shotshell.

* * * * *